US005813091A

United States Patent [19]

Chaumat

[11] Patent Number: 5,813,091

[45] Date of Patent: Sep. 29, 1998

[54] SAFETY DEVICE FOR A DOOR

[76] Inventor: Bernard Chaumat, 10, boulevard Jourdan, 75014 Paris, France

[21] Appl. No.: 827,004

[22] Filed: Mar. 25, 1997

[51] Int. Cl.[6] ..... E05F 5/02

[52] U.S. Cl. ..... 16/82; 16/DIG. 17

[58] Field of Search ..... 16/82, 83, 85, 16/86 C, DIG. 17, DIG. 32; 49/319; 292/233, 275, DIG. 15, DIG. 30, 340, 341.15, 196

[56] References Cited

U.S. PATENT DOCUMENTS

| | | | |
|---|---|---|---|
| 558,786 | 4/1896 | Doyle | 16/82 |
| 597,425 | 1/1898 | Mumford | 16/82 |
| 768,825 | 8/1904 | Smith | 16/82 |
| 1,448,298 | 3/1923 | Hight | 16/82 |
| 1,769,514 | 7/1930 | Jones et al. | 16/DIG. 17 |
| 1,772,604 | 8/1930 | Herz | 16/DIG. 17 |
| 1,944,382 | 3/1934 | Wecker . | |
| 2,249,294 | 7/1941 | Kohler | 16/82 |
| 4,494,784 | 1/1985 | Haynes | 16/82 |

FOREIGN PATENT DOCUMENTS

| | | |
|---|---|---|
| 341 286 | 11/1920 | Germany . |
| 26 14 822 | 10/1976 | Germany . |

*Primary Examiner*—Chuck Mah

*Attorney, Agent, or Firm*—Sughrue, Mion, Zinn, Macpeak & Seas, PLLC

[57] ABSTRACT

A safety device for automatically preventing a door accidentally closing completely. The door comprises at least one panel (2) provided with an actuator member (3) and hinged in a doorframe (4, 5, 6). The safety device comprises a moving member (10) displaceable between a safety position in which it prevents the door closing completely and a closure position in which the door can be closed, the moving member being connected (20) to the actuator member such that actuating the actuator member displaces the moving member towards its closure position.

7 Claims, 4 Drawing Sheets

SAFETY DEVICE FOR A DOOR

The present invention relates to a safety device for a door, and more particularly to a safety device for preventing a door from closing accidentally.

BACKGROUND OF THE INVENTION

Doors in common use generally comprise a panel hinged in a doorframe about a hinge. That type of door presents a significant accident risk when, for any reason whatsoever, the hinged panel closes suddenly in the doorframe. A person, in particular a child, having a hand resting on the upright of the frame that is remote from the hinge, runs the risk of having fingers suddenly jammed between the frame and the hinged panel.

Naturally, in the state of the art, devices are known for braking the closing of a hinged panel so that the risk of jamming the fingers is greatly reduced. Nevertheless, such devices are quite complicated and expensive to manufacture since they often include means such as hydraulic cylinders for providing braking. Similarly, such devices do not completely prevent the door from closing so it is still possible for the person's hand to be jammed between the doorframe and the door.

Document DE-C-341 286 discloses a device for locking a window in the open position. Nevertheless, after the window has been unlocked from its open position, there is nothing to prevent it from shutting suddenly and completely, thereby injuring somebody.

Document DE-A-26 14 822 discloses a device for preventing a door from accidentally closing completely, the device including a moving member that is directly displaceable between two positions by the user. The device is therefore not automatic, and if the safety feature is not initially engaged, then the risk of an accident is not removed.

OBJECTS AND SUMMARY OF THE INVENTION

An object of the present invention is to provide a door safety device which is simple and cheap to make. Another object of the present invention is to provide such a door safety device which automatically prevents the door accidentally closing completely. A further object of the invention is to provide such a door safety device which operates automatically and under all circumstances to prevent fingers placed on the doorframe being accidentally jammed when the door is closed.

The present invention thus provides a safety device for automatically preventing a door accidentally closing completely, the door comprising at least one panel provided with an actuator member and hinged in a doorframe, the safety device comprising a moving member displaceable between a safety position in which it prevents the door closing completely and a closure position in which the door can be closed, said moving member being connected to said actuator member in such a manner that actuating the actuator member displaces said moving member towards its closure position.

Thus, it is necessary for a person to act on the actuator member in order to enable the door to be closed completely. This is a guarantee against any possibility of accident-since the person acting on the actuator member will previously have taken their hand off the doorframe.

Preferably, in the safe position of the moving member, the edge of the hinged panel which is remote from the hinge of the door, and the corresponding upright of the doorframe define a gap of at least a few centimeters, such that the fingers of a hand cannot be jammed between said edge and said upright.

Thus, if the door shuts suddenly, e.g. under the effect of a draft, a person having a hand placed on the doorframe on the side thereof that is remote from the door hinge, does not run any risk of having fingers jammed since the door will be stopped by said moving member with the minimum gap defined by the invention corresponding approximately to the thickness of a person's hand.

Advantageously, said moving member is located level with the top edge of the hinged panel of the door.

Advantageously, said moving member, in its safe position, extends beyond the top edge of the hinged panel such that it co-operates with the doorframe or with an element secured to said doorframe to prevent the door closing completely, and in its closure position, lies beneath the top edge of the hinged panel so that the door can be closed.

Preferably, said moving member is urged towards its safe position by a spring.

Advantageously, said moving member and said spring are disposed in a hollow cylinder fixed inside said hinged panel of the door.

Advantageously, said moving member is connected to said actuator member by a cable.

Preferably, said moving member, in its closure position, co-operates with an abutment element fixed on the lintel of the doorframe.

Advantageously, the doorframe is standard and includes a conventional rabbet.

Preferably, said actuator member is formed by the handle of the door.

The present invention also provides a door including a safety device as defined above.

BRIEF DESCRIPTION OF THE DRAWINGS

Other characteristics and advantages of the present invention appear from the following detailed description given by way of non-limiting example and with reference to the accompanying drawings, in which.

MORE DETAILED DESCRIPTION

Figure 1:
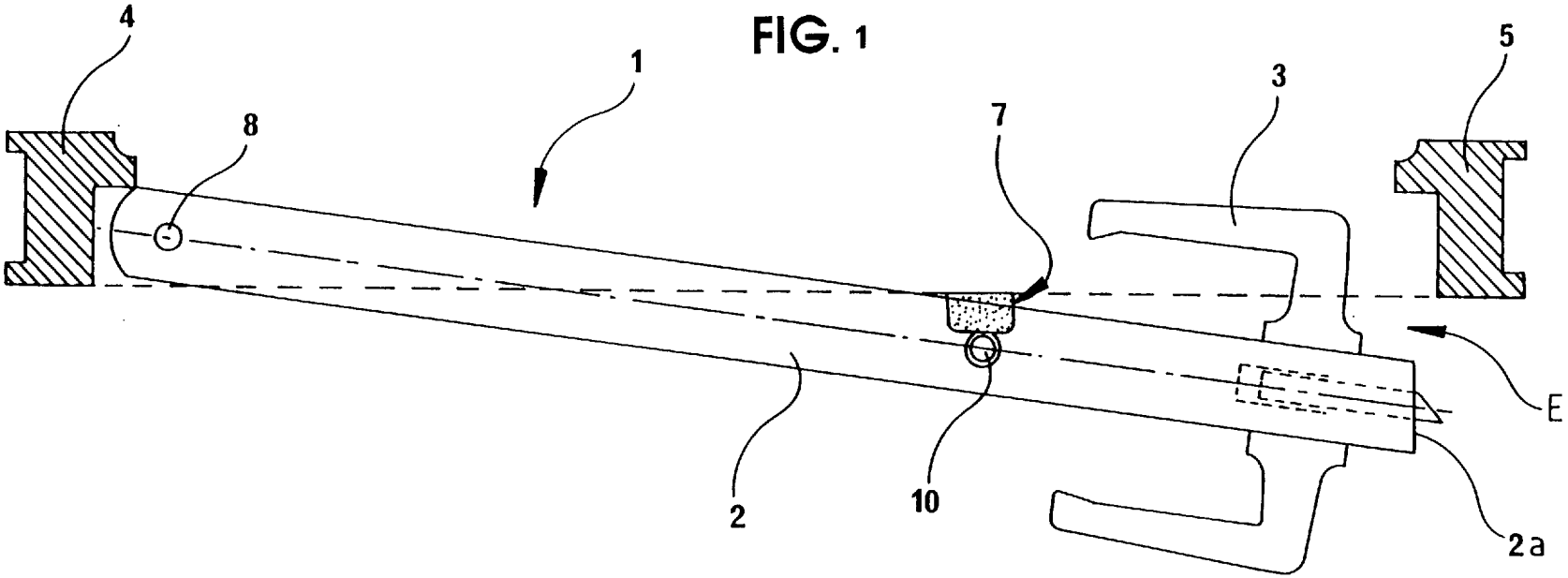
FIG. 1 is a diagrammatic plan view of a door including a safety device of the invention.
Figure 2:
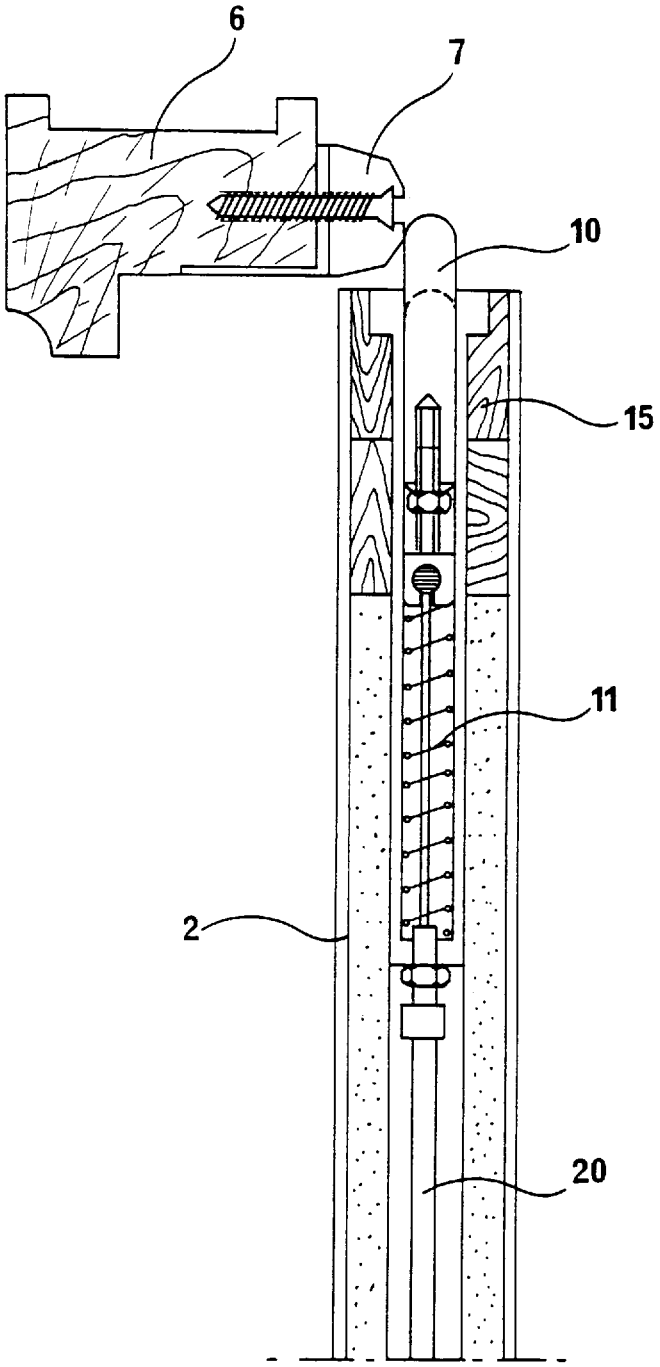
FIG. 2 is a diagrammatic section view of an embodiment of the device of the invention.

With reference to FIGS. 1 and 2, a door embodying the invention comprises a hinged panel 2 received in a doorframe. The panel 2 is hinged about a hinge 8. The doorframe comprises a lintel 6 interconnecting two uprights 4 and 5. The upright situated adjacent to the hinge 8 of the panel 2 is referred to below as the "supporting" upright 4 and the upright remote from the hinge 8 of the panel 8 is referred to below as the "non-supporting" upright 5. As can be seen in particular in FIGS. 1 and 2, the doorframe may be standard and may include a conventional type of rabbet. The hinged panel 2 includes an actuator member 3 which is advantageously formed by a handle for operating the door.

Figure 3:
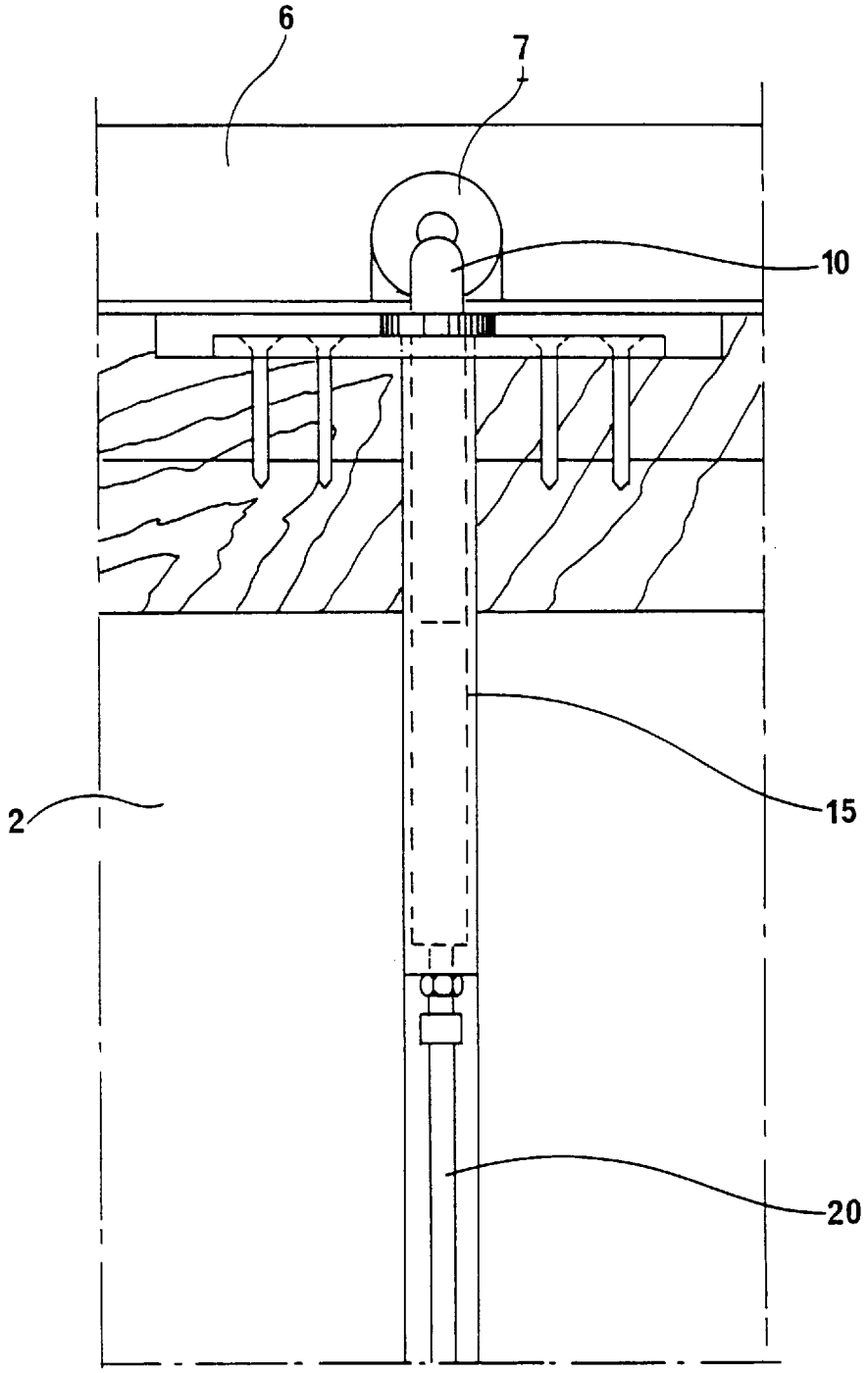
FIG. 3 is a diagrammatic front view of an embodiment of the invention.

According to the invention, a moving member 10 is provided which moves between a safety position in which it prevents the door 1 from closing completely and a closure position in which it allows the door 1 to be closed completely. The moving member 10 is preferably located near the top edge of the hinged panel 2 of the door 1, as shown in FIGS. 2 and 3. Advantageously, this moving member, when in its safety position as shown in FIGS. 2 and 3, projects above the top edge of the hinged panel 2 so as to prevent the door closing completely by co-operating either directly with the lintel 6 of the doorframe itself, or else with an element 7 secured to said lintel 6. With reference to FIGS. 1, 2, and 3, an abutment element 7 is advantageously provided which is fixed to the lintel 6 of the doorframe and with which said moving member 10 co-operates to stop the door 1 in the event of accidental closure. As can be seen more particularly in FIG. 1, when the moving member 10 co-operates with said abutment element 7, a minimum gap E is defined between the edge 2*a* of the hinged panel 2 that is remote from the hinge 8 and the non-supporting upright 5 of the doorframe, such that a person having fingers resting on the frame at this location is in no danger of having them jammed, even in the event of the door panel 2 closing or even slamming accidentally.

According to the invention, said moving member 10 is connected to the handle 3 of the door in such a manner that actuating the handle 3 moves said member 10 from its safety position towards its closure position. Advantageously, said moving member 10 is connected to the door 3 by a cable 20. The cable may be of any type, and in particular it may be similar to a bicycle brake cable. Advantageously, said moving member 10 is urged towards its safety position by a spring 11, or by any other equivalent resilient means, such that without action being taken on the door handle 3, the moving member 10 stays in its safety position and will come into abutment against the abutment element 7 to prevent the door from closing completely. Complete closure becomes possible only when the handle is actuated, thereby using the cable 20 to move the moving member 10 into the closure position against the force of the spring 11. Advantageously, the moving member 10, and possibly also the spring 11, are placed in a hollow cylinder 15 which is fixed in said hinged panel 2 of the door. This implementation makes it possible to reinforce said moving member 10 such that in the event of the hinged panel 2 slamming shut, said hollow cylinder can absorb a portion of the inertial forces and thus avoid damaging the door, and in particular the top edge of the panel 2.

The cable 20 can be fixed in any known desired manner to the moving member 10 and to the handle 3. Optionally, means for accurately adjusting the fixing of the cable 20 to the moving member 10 and to the handle 3 can be provided at each end of said cable 20.

Figure 4:
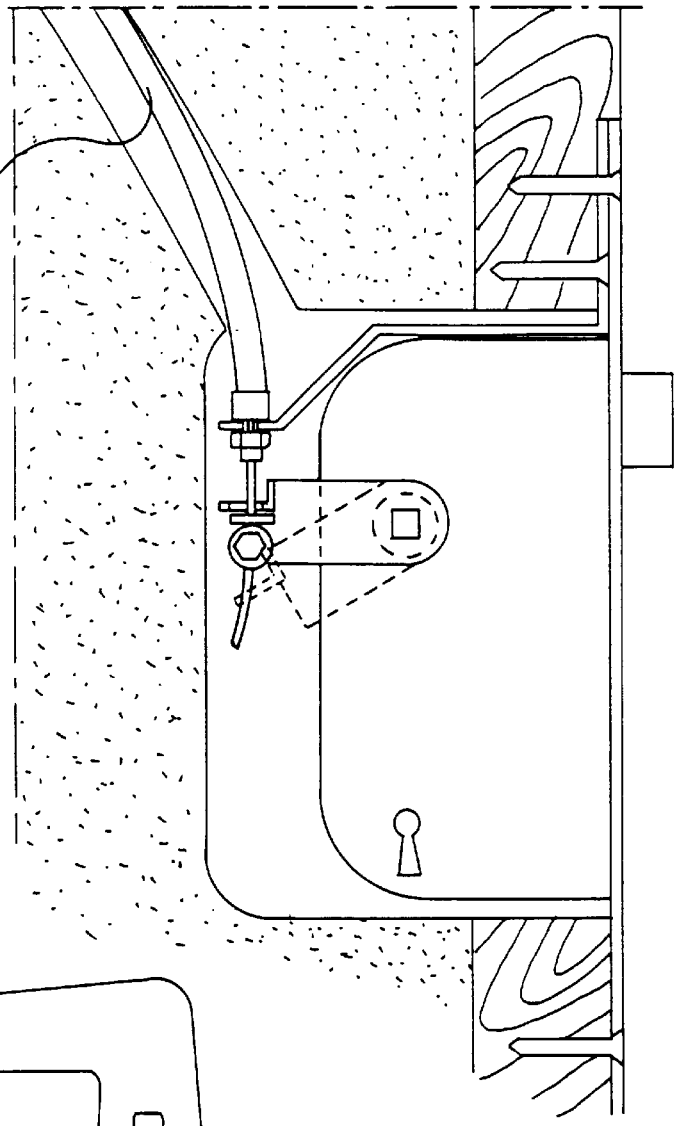
FIG. 4 is a diagrammatic section through a door handle including a device of the invention.
Figure 5:
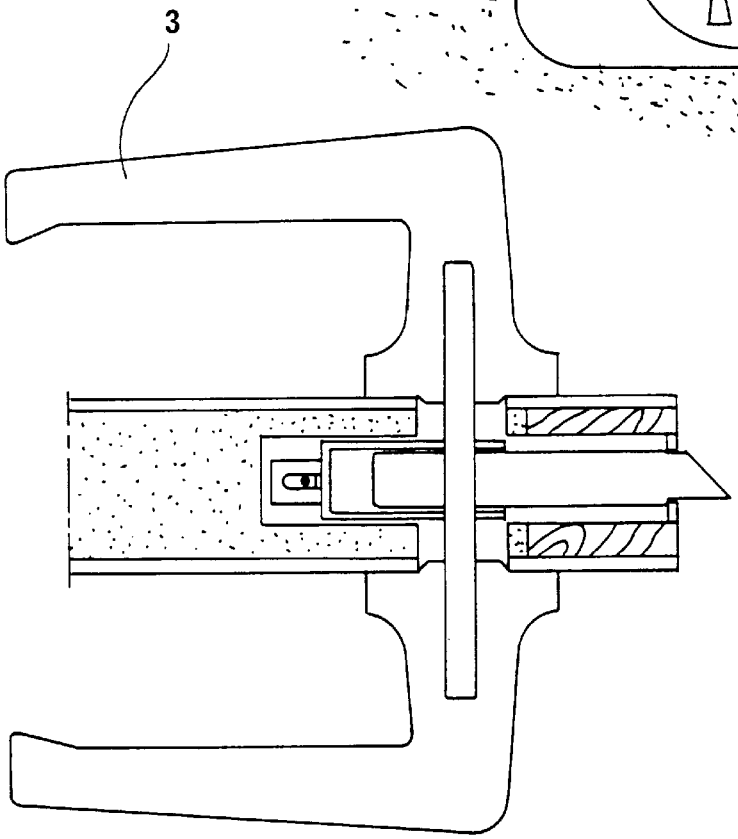
FIG. 5 is a diagrammatic plan view of a door handle incorporating a safety device of the invention.

Operation of the device of the invention is thus very simple: when the panel 2 of the door 1 closes, the moving member 10 projects above the hinged panel 2 so it co-operates with the abutment element 7 fixed on the lintel 6 of the doorframe and prevents the door from closing completely, while guaranteeing the minimum gap E between the hinged panel 2 and the non-supporting upright 5 of the doorframe. To close the door completely, it is necessary to actuate the handle 3, and in particular to lower it, which, as shown in FIG. 4, exerts traction on the cable 20, said traction being transmitted to the moving member 10 against the force of the spring 11 so that the moving member 10 moves towards its closed position in which it is located completely inside the hollow cylinder 15 fixed in the hinged panel 2 of the door. This enables the door to be closed completely and there is no danger of the fingers being jammed while this is happening.

Although the present invention is described with reference to a particular embodiment of the invention, naturally any other equivalent variants could be used. Thus, the moving member 10 can co-operate with the lintel 6 of the doorframe directly in order to prevent the door closing. Similarly, the invention could also be applied to doors that do not have handles. Under such circumstances, it would be necessary to provide a special actuator element enabling the user of the door to actuate the safety device to move the moving member 10 towards its door-closure position. In addition, the moving member may be located level with the top edge of the panel 2, but on the outside thereof.

I claim:

1. A safety device for automatically preventing a door from accidentally closing completely, the door comprising at least one panel provided with an actuator member and hinged in a doorframe, the safety device comprising a movable member displaceable between a safety position in which it prevents the door from closing completely and a closure position in which the door can be closed, said movable member being located at a top edge of the hinged panel of the door, and said movable member, in its safety position, extending beyond the top edge of the hinged panel such that it cooperates with one of the doorframe and an element secured to said doorframe to prevent the door closing completely, and in its closure position, lies beneath the top edge of the hinged panel so that the door can be closed, said movable member being connected to said actuator member in such a manner that actuating the actuator member displaces said movable member towards its closure position.

2. A safety device according to claim 1, mounted on a hinged panel, in which, in the safety position of the movable member, an edge of the hinged panel remote from the hinge of the door, and a corresponding upright of the doorframe, define a gap of a least a few centimeters, such that the fingers of a hand cannot be jammed between said edge and said upright.

3. A safety device according to claim 1, in which said movable member is urged towards its safety position by a spring.

4. A safety device according to claim 3, in which said movable member and said spring are disposed in a hollow cylinder fixed inside said hinged panel of the door.

5. A safety device according to claim 1, in which said movable member is connected to said actuator member by a cable.

6. A safety device according to claim 1, in which said movable member, in its closure position, co-operates with an abutment element fixed on the lintel of the doorframe.

7. A safety device according to claim 1, in which said actuator member is formed by the handle of the door.

* * * * *